US009774120B2

(12) United States Patent
Liao

(10) Patent No.: US 9,774,120 B2
(45) Date of Patent: Sep. 26, 2017

(54) ELECTRICAL CONNECTOR ASSEMBLY

(71) Applicant: FOXCONN INTERCONNECT TECHNOLOGY LIMITED, Grand Cayman (KY)

(72) Inventor: Fang-Jwu Liao, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/435,164

(22) Filed: Feb. 16, 2017

(65) Prior Publication Data

US 2017/0237190 A1 Aug. 17, 2017

(30) Foreign Application Priority Data

Feb. 16, 2016 (CN) ..... 2016 2 0122240 U

(51) Int. Cl.

| | |
|---|---|
| ***H01R 12/00*** | (2006.01) |
| ***H01R 12/79*** | (2011.01) |
| ***H01R 12/70*** | (2011.01) |
| ***H01R 13/24*** | (2006.01) |

(52) U.S. Cl.

CPC ..... *H01R 12/79* (2013.01); *H01R 12/7005* (2013.01); *H01R 13/24* (2013.01)

(58) Field of Classification Search

USPC ..... 439/67

See application file for complete search history.

(56) References Cited

U.S. PATENT DOCUMENTS

| | | | | |
|---|---|---|---|---|
| 8,052,464 | B2 * | 11/2011 | Maruishi | H01R 12/79 439/77 |
| 8,753,143 | B2 * | 6/2014 | Su | H01R 4/024 439/492 |
| 8,845,358 | B2 * | 9/2014 | Kitagawa | H01R 12/79 439/357 |
| 9,209,540 | B2 * | 12/2015 | Raff | H01R 12/79 |
| 9,281,597 | B2 * | 3/2016 | Hashiguchi | H01R 12/79 |
| 2014/0141628 | A1 * | 5/2014 | Hsu | H01R 12/79 439/67 |

FOREIGN PATENT DOCUMENTS

| | | |
|---|---|---|
| TW | M474269 | 9/2013 |
| TW | M485525 | 3/2014 |

* cited by examiner

*Primary Examiner* — Tho D Ta

(74) *Attorney, Agent, or Firm* — Wei Te Chung; Ming Chieh Chang

(57) ABSTRACT

An electrical connector assembly comprises an electrical connector and a circuit board assembly mating with the electrical connector. The electrical connector comprises an insulative housing and a plurality of terminals retained in the insulative housing. The insulative housing defines a mating surface and a mounting surface. Each of the terminal comprises a contacting portion extending out of the mating surface and a connecting portion extending out of the mounting surface. The circuit board assembly comprises a hard circuit board and a flexible printed circuit board fixing on the hard circuit board. The hard circuit board comprises a plurality of conductive portions. When the circuit board assembly mating with the electrical connector, the conductive portions connect with the contacting portion. The electrical connector assembly can not only facilitate the disassembly and assembly of the circuit board assembly, but also prevent the circuit board assembly from being damaged in welding.

14 Claims, 5 Drawing Sheets

ELECTRICAL CONNECTOR ASSEMBLY

BACKGROUND OF THE INVENTION

1. Field of the Invention

The present invention relates generally to an electrical connector assembly, more particularly to an electrical connector assembly connected to a main board.

2. Description of Related Arts

Taiwan Patent No. TWM474269 issued on Mar. 11, 2014, discloses a circuit board assembly for electrically connecting with an electronic device including a soft plate, a first hard plate set on the upper of the soft plate and a plurality of soldering materials set on the first hard plate. The soft plate defines a plurality of lines. The soldering materials connect with the lines. The hard plate is soldered to the electronic device by the soldering materials to achieve electrical connections. When the circuit board assembly is directly welded and fixed to the electronic device, the adjacent lines of the soft plate may be lapped together by the heated soldering materials to influence the normal use of the soft plate. At the same time, the soft plate may also be damaged by heat during soldering. What's more, the circuit board assembly directly soldered to electronic device is not conducive to the removal and replacement of them in the future.

Hence, a new electrical connector assembly is desired to improve those disclosed in the aforementioned proposal.

SUMMARY OF THE INVENTION

Accordingly, the object of the present invention is to provide a electrical connector assembly which can not only facilitate the disassembly and assembly of the circuit board assembly, but also prevent the circuit board assembly from being damaged.

To fulfill the above-mentioned object, an electrical connector assembly comprises an electrical connector and a circuit board assembly mating with the electrical connector. The electrical connector comprises an insulative housing and a plurality of terminals retained in the insulative housing. The electrical connector defines a mating surface and a mounting surface. Each of the terminal comprises a contacting portion extending out of the mating surface and a connecting portion extending out of the mounting surface. The circuit board assembly comprises a hard circuit board and a flexible printed circuit board fixing on the hard circuit board. The hard circuit board comprises a plurality of conductive portions. When the circuit board assembly mating with the electrical connector, the conductive portions connect with the contacting portion.

DETAILED DESCRIPTION OF THE PREFERRED EMBODIMENT

Figure 1:
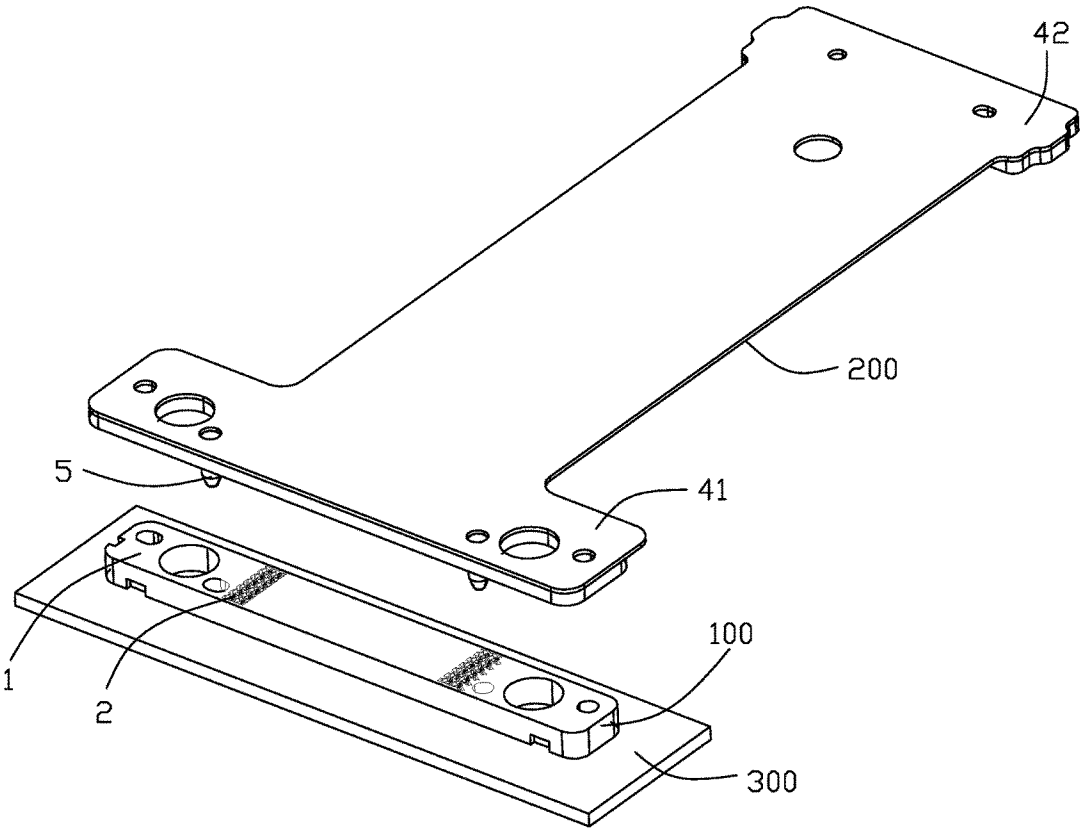
FIG. 1 is a top perspective view of an electrical connector assembly of which a electrical connector fixing on a main board and a circuit board assembly are separated.

Reference will now be made in detail to the preferred embodiment of the present invention.

Referring to FIGS. 1-5, an electrical connector assembly 1000 comprises an electrical connector 100 and a circuit board assembly 200 mating with the electrical connector 100. The electrical connector 100 comprises an insulative housing 1 and a plurality of terminals 2 retained in the insulative housing 1. The electrical connector 100 defined a mating surface 11 and a mounting surface 12. Each of the terminal 2 comprises a contacting portion 21 extending out of the mating surface 11 and a connecting portion 22 extending out of the mounting surface 12. Each of the contacting portions 21 has a pair of beams 211 protruding upwardly beyond. The contacting portions 21 are angled relative to a transversal direction of the insulative housing 1. The circuit board assembly 200 comprises a hard circuit board 3 and a flexible printed circuit board 4 fixing on the the hard circuit board 3. The hard circuit board 3 comprises a plurality of conductive portions 31. When the circuit board assembly 200 mating with the electrical connector 100, the conductive portions 31 connect with the contacting portion 21. The hard circuit board 3 has storage function.

Figure 2:
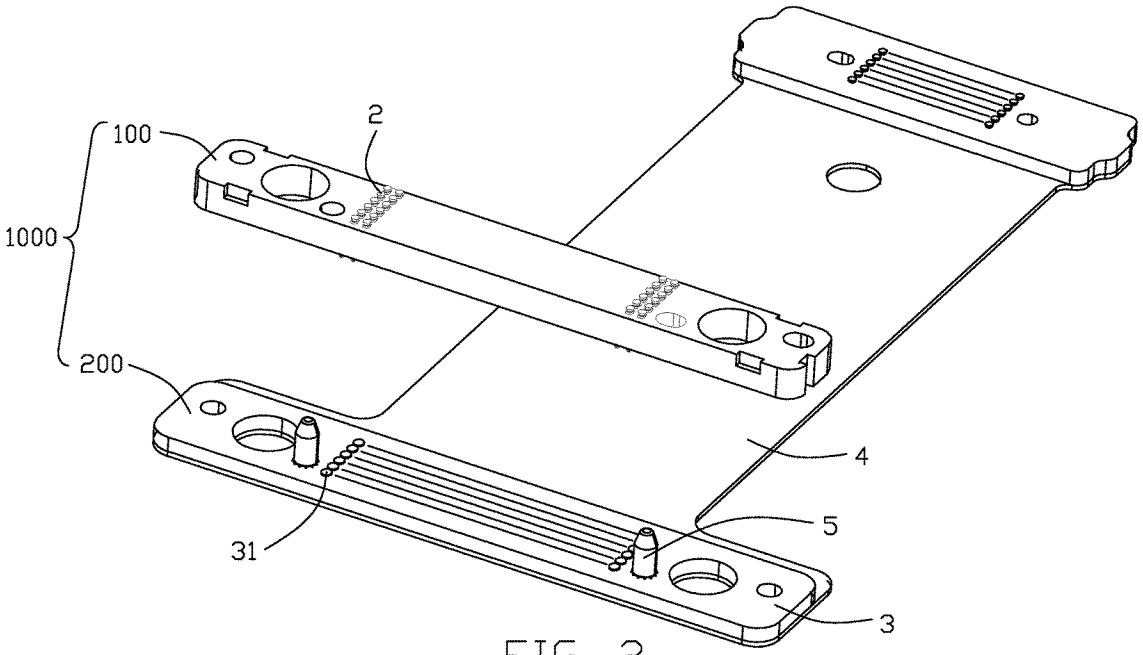
FIG. 2 is another point of view perspective view of the electrical connector assembly shown in FIG. 1.
Figure 3:
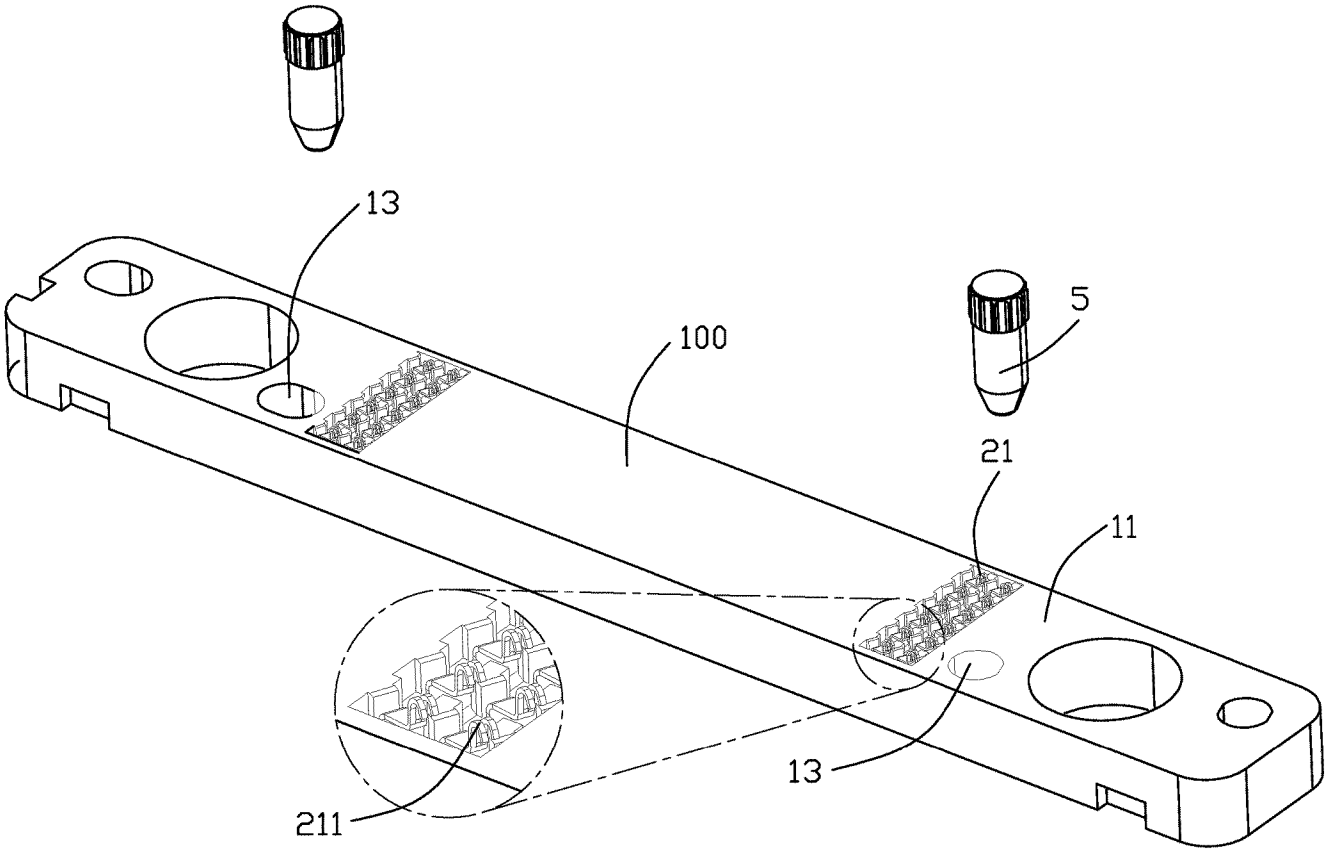
FIG. 3 is a perspective view of the dowel pins of the circuit board assembly and the electrical connector shown in FIG. 1.

Referring to FIGS. 1-3, the electrical connector 100 comprises pilot holes 13. The circuit board assembly 200 comprises dowel pins 5 corresponding to the pilot holes 13. The head of the dowel pin 5 defines as a tapered structure. The tapered structure has a guiding effect on alignment. The electrical connector 100 comprises a pair of the pilot holes 13, the two of the pilot holes 13 have different shape for providing adjustable area extending in a transversal direction to the dowel pins 5 when assembling the dowel pins 5 into the pilot holes 13. In the preferred embodiment of the present invention, one of the pilot holes 13 has a circular shape, and another one of the pilot holes 13 has an oval shape in which the major axis is disposed in the transversal direction; while both of the dowel pins 5 are circle shape. If the distance between the two dowel pins 5 in the transversal direction is within a reasonable range, the relative position of the dowel pins 5 and the pilot holes 13 can be adjusted along the transversal direction at the time of assembly. That is conducive to the smooth assembly of the dowel pins 5 and the pilot holes 13. The flexible printed circuit 4 comprises a first end 41 and a second end 42 opposite to the first end. In the preferred embodiment of the present invention, the hard circuit board 3 is fixed to the first end 41 of the flexible circuit board 4 by pressing fit.

Figure 4:
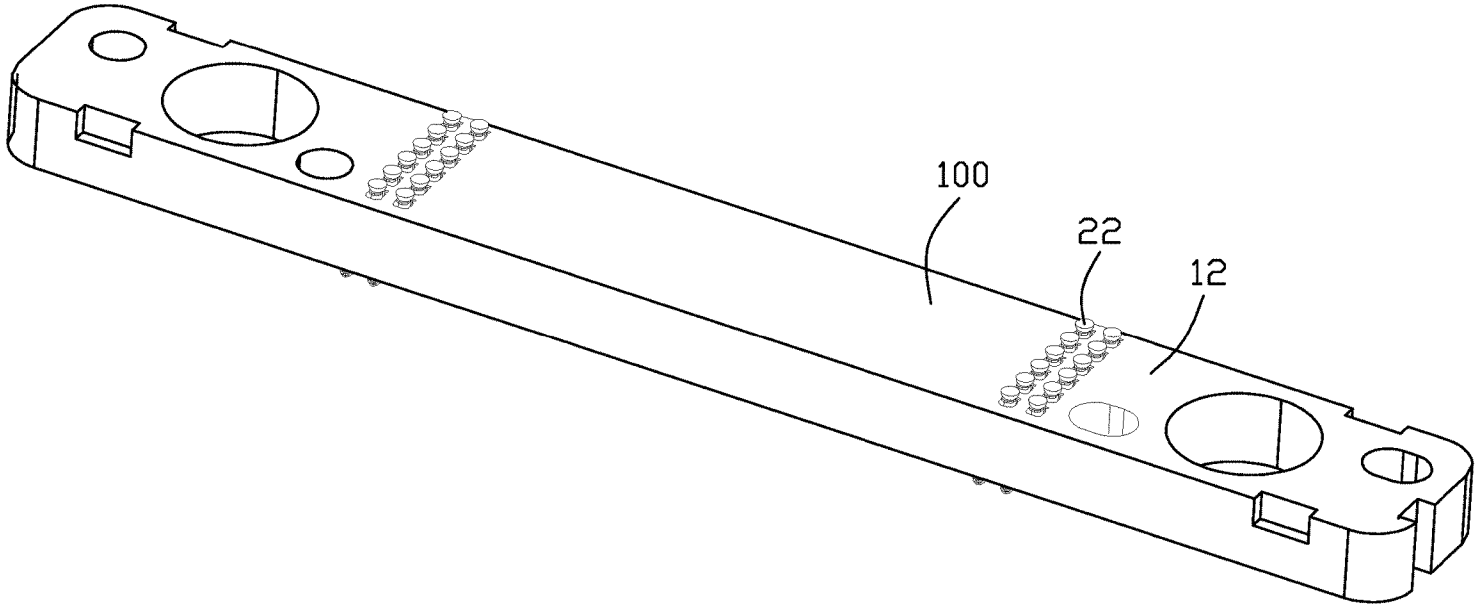
FIG. 4 is another point of view perspective view of the electrical connector shown in FIG. 3.
Figure 5:
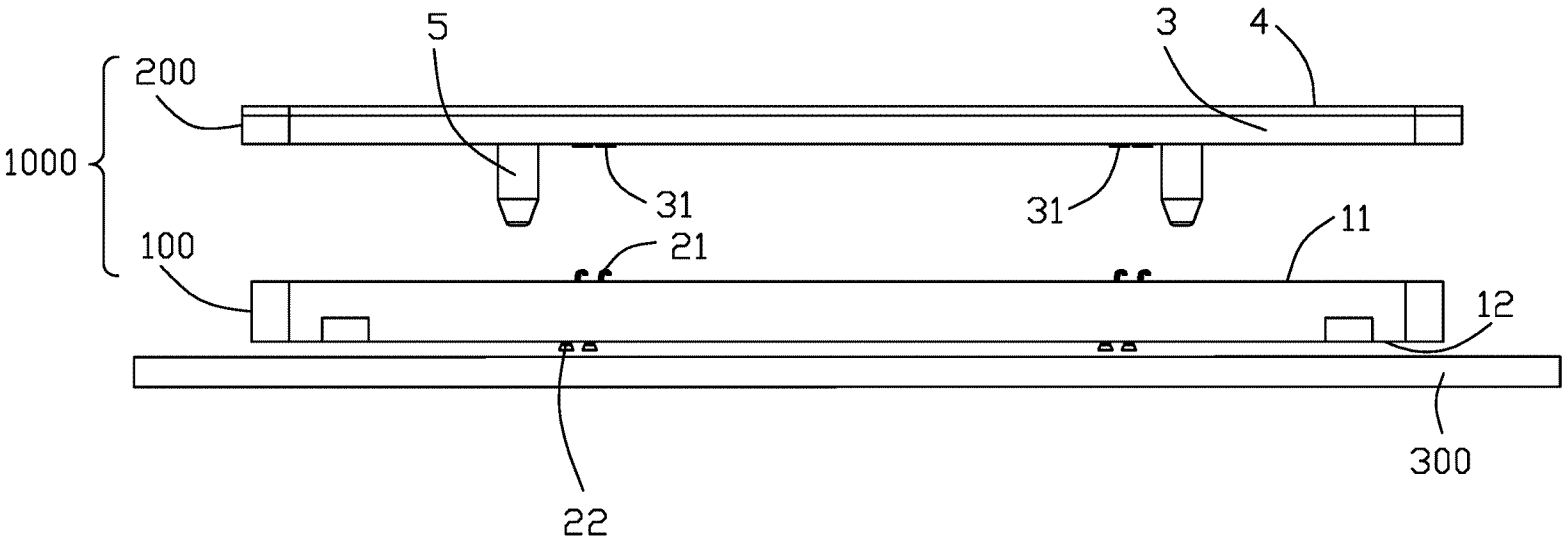
FIG. 5 is a front view of the electrical connector shown in FIG. 1.

Referring to FIGS. 3-5, the electrical connector 100 is arranged in a flat shape. This is favorable for the miniaturization of the electric connector assembly 1000 and saving the space of the equipment. The conductive portion 31 is a flat shape metallic pad. The conductive portions 31 and the flexible circuit printed board 4 are respectively located on two opposite sides of the hard circuit board 3. The hard circuit board 3 and the flexible circuit board 4 are provided with mutually connected wires (not shown). The wires can be electrically contacted with the conductive portions 31, so that the flexible circuit board 4 and the conductive portions 31 are electrically connected to each other.

Referring to FIG. 5, the dowel pins 5 extend in the mating direction and are arranged on both ends of the conductive portions 31 in the transversal direction. The contacting portion 21 of the terminals 2 are resiliently connected to the conductive portions 31 of the circuit board assembly 200. In this way, the electric connector 100 is connected with the circuit board assembly 200. The connecting portion 22 of the terminals 2 are soldered to a main board 300. In this way, the electric connector 100 is connected with the main board 300. Therefore, the circuit board assembly 200 is electrically connected with the main board 300. The method of establishing an electrical connection between the circuit board assembly 200 and the main board 300 by the electrical connector 100 can effectively reduce the bad influence of the flexible circuit board 4 by the soldering materials lapping during the process in which the circuit board assembly 200 is directly soldered to the main board 300. The electrical connector assembly 1000 can not only facilitate the disassembly and assembly of the circuit board assembly 200, but also prevent the circuit board assembly 200 from being damaged.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector assembly comprising:

an electrical connector defining a mating surface and a mounting surface opposite to the mating surface, the electrical connector comprising an insulative housing and a plurality of terminals retained in the insulative housing, each of the terminal comprising a contacting portion extending out of the mating surface and a connecting portion extending out of the mounting surface;

and a circuit board assembly mating with the electrical connector;

wherein the circuit board assembly comprises a hard circuit board and a flexible printed circuit board fixing on the hard circuit board, and the hard circuit board comprises a plurality of conductive portions; wherein when the circuit board assembly is mated with the electrical connector, the conductive portions connect with the contacting portion;

wherein the electrical connector comprises a pair of pilot holes, the circuit board assembly comprises a pair of dowel pins corresponding to the pair of pilot holes;

wherein the two of the pilot holes have different shape for providing adjustable area extending in a transversal direction to the dowel pins when assembling the dowel pins into the pilot holes.

2. The electrical connector assembly as claimed in claim 1, wherein the head of the dowel pin defines as a tapered structure.

3. The electrical connector assembly as claimed in claim 1, wherein one of the pilot holes is a circle shape, the other is an ellipse shape; while both of the dowel pins are circle shape.

4. The electrical connector assembly as claimed in claim 1, wherein the electrical connector is arranged in a flat shape.

5. The electrical connector assembly as claimed in claim 1, wherein the dowel pins extend in the mating direction and are arranged on both ends of the conductive portions in the transversal direction.

6. The electrical connector assembly as claimed in claim 1, wherein the flexible printed circuit comprises a first end and a second end opposite to the first end, the hard circuit board is fixed to the first end of the flexible circuit board by pressing fit.

7. The electrical connector assembly as claimed in claim 1, wherein one of the pilot holes has a circular shape, and another one of the pilot holes has an oval shape in which the major axis is disposed in the transversal direction.

8. The electrical connector assembly as claimed in claim 1, wherein the conductive portion is a flat shape metallic pad, the conductive portions and the flexible circuit printed board are respectively located on two opposite sides of the hard circuit board, the flexible circuit board and the conductive portions are electrically connected to each other.

9. The electrical connector assembly as claimed in claim 8, wherein the contacting portions of the terminals are resiliently connected to the conductive portions of the circuit board assembly, the connecting portion of the terminals are soldered to a main board.

10. The electrical connector assembly as claimed in claim 1, wherein the hard circuit board has storage function.

11. The electrical connector assembly as claimed in claim 10, wherein the hard circuit board and the flexible circuit board are provided with mutually connected wires, the wires can be electrically contacted with the conductive portions.

12. The electrical connector assembly as claimed in claim 1, wherein each of the contacting portions has a pair of beams protruding upwardly beyond.

13. The electrical connector assembly as claimed in claim 12, wherein the contacting portions are angled relative to a transversal direction of the insulative housing.

14. An electrical connector assembly comprising: a main board;

an electrical connector positioned upon the main board and including:

an insulative housing with thereon a mating surface and a mounting surface opposite to each other in a vertical direction, said mounting surface intimately confronting the main board;

a plurality of terminals retained in the insulative housing, each of the terminal comprising a resilient contacting portion extending out of the mating surface and a connecting portion extending out of the mounting surface and mounted upon the main board; and a circuit board assembly mating with the electrical connector; wherein the circuit board assembly comprises a hard circuit board and a flexible printed circuit board fixing on the hard circuit board so as to have the hard circuit board intimately confronting the mating surface, and the hard circuit board comprises a plurality of conductive portions downward pressing the corresponding resilient contacting portions, respectively;

wherein the connecting portion is soldered upon the main board;

wherein the hard circuit board includes a pair of dowel pins and the housing includes a pair of pilot holes respectively receiving said pair of dowel pins;

wherein the housing forms a pair of holes by two sides of the pair of pilot holes in a longitudinal direction perpendicular to said vertical direction;

wherein the hard circuit board forms a pair of holes by two sides of the pair of dowel pins in the longitudinal direction;

wherein the two of the pilot holes have different shape for providing adjustable area extending in the longitudinal direction to the dowel pins when assembling the dowel pins into the pilot holes.

* * * * *